US009644643B2

(12) United States Patent
Bizzarro

(10) Patent No.: US 9,644,643 B2
(45) Date of Patent: May 9, 2017

(54) ASPIRATOR PUMP WITH DUAL HIGH PRESSURE STREAMS

(71) Applicant: Hamilton Sundstrand Corporation, Windsor Locks, CT (US)

(72) Inventor: Peter Bizzarro, Canton, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 278 days.

(21) Appl. No.: 14/541,968

(22) Filed: Nov. 14, 2014

(65) Prior Publication Data

US 2016/0138615 A1 May 19, 2016

(51) Int. Cl.
*F04F 5/20* (2006.01)
*F04F 5/24* (2006.01)
*F04F 5/48* (2006.01)

(52) U.S. Cl.
CPC ..... *F04F 5/24* (2013.01); *F04F 5/20* (2013.01); *F04F 5/48* (2013.01)

(58) Field of Classification Search
CPC ..... F04F 5/20; F04F 5/24; F04F 5/48; F25B 1/06
USPC ..... 137/115.11, 565.22, 888, 889, 896; 417/151, 174; 165/123; 62/191, 500; 244/118.5
See application file for complete search history.

(56) References Cited

U.S. PATENT DOCUMENTS 1,835,603 A 12/1931 Kincaid, Jr.
2,366,277 A 1/1945 Madine, Sr.
2,502,332 A 3/1950 McCollum
3,545,886 A 12/1970 Chalom
4,014,961 A 3/1977 Popov
4,302,151 A 11/1981 Piguet et al.
(Continued)

FOREIGN PATENT DOCUMENTS

DE 10050697 A1 4/2002
DE 102006018066 A1 * 10/2007 ..... B05B 7/1404
(Continued)

OTHER PUBLICATIONS

Translation of DE 102006018066 A1; Oct. 2007; Keudell Leopold Von.*

(Continued)

*Primary Examiner* — Michael R Reid
*Assistant Examiner* — Paul J Gray
(74) *Attorney, Agent, or Firm* — Kinney & Lange, P.A.

(57) ABSTRACT

A three stream aspirator includes an upstream passage for receiving and discharging a motivator stream, a low pressure passage for receiving and discharging a low pressure stream, and a Venturi for receiving and discharging the motivator stream and for drawing the low pressure stream through the low pressure passage. The aspirator body also includes a mixing passage for receiving and mixing the motivator stream and the low pressure stream, and a first aspirator outlet, located at the end of the mixing passage, configured to discharge the mixed stream from the aspirator. The aspirator body further includes an isolated passage for receiving a high pressure stream, wherein the high pressure stream is isolated from any other stream while within the aspirator; and a second aspirator outlet, adjacent to the first aspirator outlet, from which the high pressure stream is discharged.

13 Claims, 2 Drawing Sheets

(56) References Cited

U.S. PATENT DOCUMENTS

| | | | | | |
|---|---|---|---|---|---|
| 4,781,537 | A | * | 11/1988 | Nicodemus | F04F 5/467 239/443 |
| 4,823,550 | A | | 4/1989 | Decker | |
| 5,016,819 | A | | 5/1991 | Wood | |
| 5,586,442 | A | * | 12/1996 | Nicodemus | F04F 5/00 417/173 |
| 5,794,447 | A | * | 8/1998 | Nicodemus | F01K 19/08 417/197 |
| 8,104,745 | B1 | | 1/2012 | Fisenko | |
| 8,505,310 | B2 | | 8/2013 | Zhang et al. | |
| 8,579,596 | B2 | | 11/2013 | Huntley | |
| 8,795,602 | B2 | | 8/2014 | Ergut | |
| 2015/0033791 | A1 | | 2/2015 | Yamada et al. | |

FOREIGN PATENT DOCUMENTS

| | | | |
|---|---|---|---|
| SU | 1089304 | A2 | 4/1984 |
| WO | WO0061948 | A1 | 10/2000 |
| WO | WO2013132769 | A1 | 9/2013 |

OTHER PUBLICATIONS

Extended European Search Report for EP Application No. 15192921.3, dated Apr. 21, 2016, 5 pages.

* cited by examiner

ASPIRATOR PUMP WITH DUAL HIGH PRESSURE STREAMS

BACKGROUND

The present disclosure relates to fluid powered pumps and more specifically to aspirator pumps.

An aspirator, or aspirator pump, uses one fluid to pump another fluid through the Venturi effect. A motivating fluid passing through a nozzle creates a vacuum drawing in a lower pressure fluid and causing a pumping effect. Aspirator pumps are commonly used in applications where mechanical pumps are not available or preferred. For example, aspirator pumps are used in situations where vibrations from a motor may be undesirable as in a laboratory or may be used in a medical procedure where suction pressure is desired. Aspirators may also be desirable where a source of energy in the form of liquid pressure is readily available, such as in steam or boiler systems. Aspirator pumps are also used when the combination of two streams of fluid is desired, such as in aircraft cooling systems.

Aspirator pumps in aircraft cooling systems have been used to draw excess air and water out of a low pressure source using a high pressure source of air or of air and water as a motivator. The motivating stream and the low pressure stream are combined in the aspirator. The combination of streams has been injected into heat exchangers to evaporate into a working stream of air near the inlet of a heat exchanger of an air conditioning system within an aircraft cooling system. This process increases the efficiency of the heat exchanger by cooling the air entering the heat exchanger.

This process is desirable not only to increase the efficiency of the heat exchanger, but to remove water from the system as the working air is eventually dumped overboard.

SUMMARY

In one embodiment, a three stream aspirator includes an upstream passage for receiving and discharging a motivator stream, a low pressure passage for receiving and discharging a low pressure stream, and a Venturi for receiving and discharging the motivator stream and for drawing the low pressure stream through the low pressure passage. The aspirator body also includes a mixing passage for receiving and mixing the motivator stream and the low pressure stream, and a first aspirator outlet, located at the end of the mixing passage, configured to discharge the mixed stream from the aspirator. The aspirator body further includes an isolated passage for receiving a high pressure stream, wherein the high pressure stream is isolated from any other stream while within the aspirator and a second aspirator outlet, adjacent to the first aspirator outlet, from which the high pressure stream is discharged.

In another embodiment, a method for discharging two individual streams using a three stream aspirator includes supplying a motivator stream into a Venturi located within the aspirator, creating a Venturi effect and drawing a low pressure stream into a mixing chamber within the aspirator using the Venturi effect. The method also includes mixing the low pressure stream and the motivator stream in the mixing chamber to create a mixed stream and discharging the mixed stream from the mixing passage at a first outlet of the aspirator. The method further includes supplying a high pressure stream into an isolated passage, isolating the high pressure stream from the mixed stream, the low pressure stream, and the motivator stream within the aspirator, and discharging the high pressure stream from the isolated passage at a second outlet of the aspirator adjacent to the first outlet of the aspirator.

DETAILED DESCRIPTION

The use of an aspirator to pump is desirable not only to increase the efficiency of the heat exchanger as described above, but to remove water from the system as the working air is eventually dumped overboard. Therefore it may be desired to inject additional high pressure sources into the aspirator to be discharged into a heat exchanger. This additional stream may provide additional cooling, further increasing the heat exchanger efficiency. The additional stream may also provide the benefit of removing unwanted fluid from the system.

Figure 1:
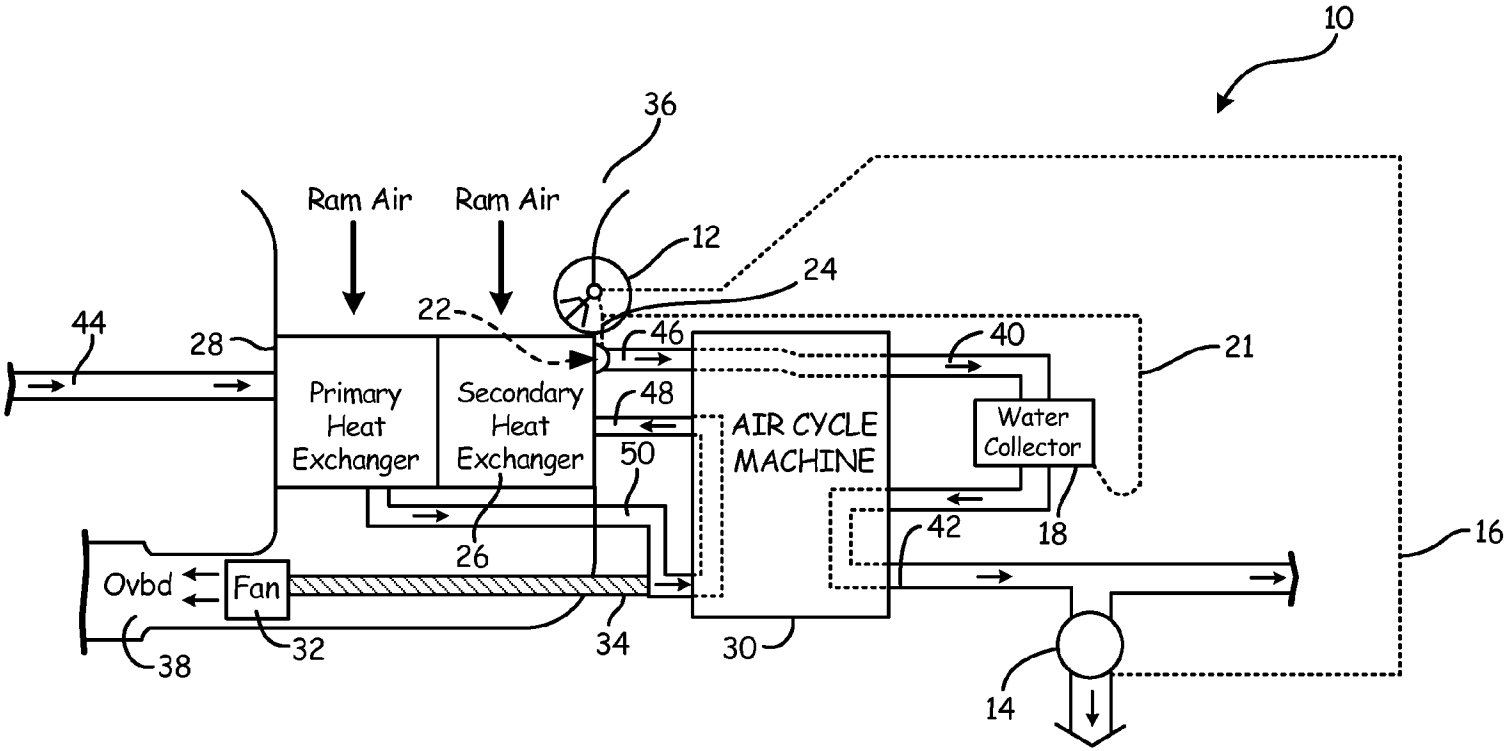
FIG. 1 is a schematic view illustrating an embodiment of an aircraft cooling system including a three stream aspirator.

FIG. 1 is a schematic view illustrating an embodiment of aircraft cooling system 10, which includes aspirator 12, low pressure source 14, low pressure stream path 16, water collector 18, motivating stream path 21, secondary heat exchanger outlet header port 22, and high pressure stream path 24. Aircraft cooling system 10 also includes secondary heat exchanger 26, primary heat exchanger 28, air cycle machine 30, fan 32, and fan drive shaft 34. Further included in aircraft cooling system 10 is ram air inlet 36 and ram air exhaust 38. Also included in aircraft cooling system 10 are water collector inlet 40, air cycle machine discharge 42, primary and secondary heat exchanger inlets 44 and 48, and primary and secondary heat exchanger outlets 50 and 46. Within air cycle machine, but not shown, are a compressor, turbine, shaft, housing, and other components required to cool and manage the fluid that passes through air cycle machine 30.

On the cooling side of secondary and primary heat exchangers 26 and 28 is ram air inlet 36, which is connected to the entering side of primary heat exchanger 28 and secondary heat exchanger 26. Aspirator 12 is connected to and located near ram air inlet 36 and the entering side of secondary heat exchanger 26. Downstream of the outlet of primary heat exchanger 28 and secondary heat exchanger 26 is fan 32, followed by ram air outlet 38. Fan 32 is connected to air cycle machine 30 through shaft 34. Shaft 34 may also connect to compressors and turbines within air cycle machine 30. In other embodiments, aircraft cooling system 10 may not use a fan to move ram air RA.

On the process side of secondary and primary heat exchangers 26 and 28 is bleed inlet 44, which is connected to the inlet of primary heat exchanger 28. Located at the outlet (of the process side) of primary heat exchanger 28 is primary heat exchanger outlet 50, which can connect to the upstream side of a compressor within air cycle machine 30. The process air leaves air cycle machine 30 at air cycle machine discharge 42 which distributes conditioned air to be used by various components within an aircraft. Downstream of this outlet is low pressure source 14, which may be a water collector or air separator. Low pressure source 14 is connected to low pressure stream path 16, which connects to three stream aspirator 12.

Also connected to air cycle machine 30 is water collector inlet 40, on which water collector 18 resides. Further connected to air cycle machine 30 is secondary heat exchanger outlet 46 which also connects to the outlet of secondary heat exchanger 26. Also connected to air cycle machine 30 is secondary heat exchanger outlet 48, which is connected to secondary heat exchanger outlet header port 22 of secondary heat exchanger 26. Connected to water collector 18 is motivating stream path 21 which is also connects to aspirator 12. Also connected to aspirator 12 is high pressure stream path 24. In addition to aspirator 12, high pressure stream path 24 connects to secondary heat exchanger 26 at secondary heat exchanger outlet header port 22.

In this embodiment, fan 32 is driven by shaft 34, which is driven by compressors and turbines within air cycle machine 30. Fan 32 draws ram air RA into ram air inlet 36. Ram air RA is sprayed with a liquid and vapor mixture by aspirator 12. The liquid of the mixture evaporates into ram air RA, lowering the temperature of air RA. Ram air RA may travel in one of two paths, the first path is into secondary heat exchanger 26, where ram air RA will be heated up by process fluids traveling from secondary heat exchanger inlet 46 to secondary heat exchanger outlet 48. The second path is to primary heat exchanger 28 where ram air RA will be heated up by bleed air entering traveling to the heat exchanger from bleed air inlet 44. Following the heat exchanges, ram air RA travels through fan 32 and is propelled through ram air exit 38 and is then exhausted overboard from the aircraft. Though primary heat exchanger 28 and secondary heat exchanger 26 are shown in a parallel configuration, a series configuration may be used in alternate embodiments.

The bleed air (process air) entering at bleed air inlet 44 travels through primary heat exchanger 28. In primary heat exchanger 28, the process air is cooled by ram air RA passing through primary heat exchanger 28. The process air then enters air cycle machine 30 where it will encounter a process component, such as a compressor. Following being subjected to at least one process, the process air can travel to secondary heat exchanger 26 by way of secondary heat exchanger inlet 48. The process air is then cooled by ram air RA through secondary heat exchanger 26, and enters water collector 40 where water may be removed from the process air before traveling into air cycle machine 30. Following its entry into air cycle machine 30, the process air may be subjected to another process component such as a turbine. Then, the process air may reenter the turbine or another process component of air cycle machine 30, or may be exhausted from air cycle machine 30 via air cycle machine discharge 42. Thereafter, the process air may be sent to various components within the aircraft to perform heating or cooling functions. Additionally, the process air may be sent to low pressure source 14, which may be a water collector or an air and water separator. Thereafter, the process air may be recirculated to any of the locations previously mentioned.

Low pressure source 14 may produce an air and water mixture which is sent to three stream aspirator 12 through low pressure stream path 16. Similarly water collector 18 may collect an air and water mixture which is sent to three stream aspirator 12 through motivating stream path 21. Also, secondary heat exchanger 26 may collect air and water within it, which may be discharged through secondary heat exchanger outlet header port 22, through high pressure stream path 24 to three stream aspirator 12, where three stream aspirator 12 may combine all of the fluid streams to be injected into ram air RA for cooling purposes as described above and in FIG. 2 in greater detail.

Figure 2:
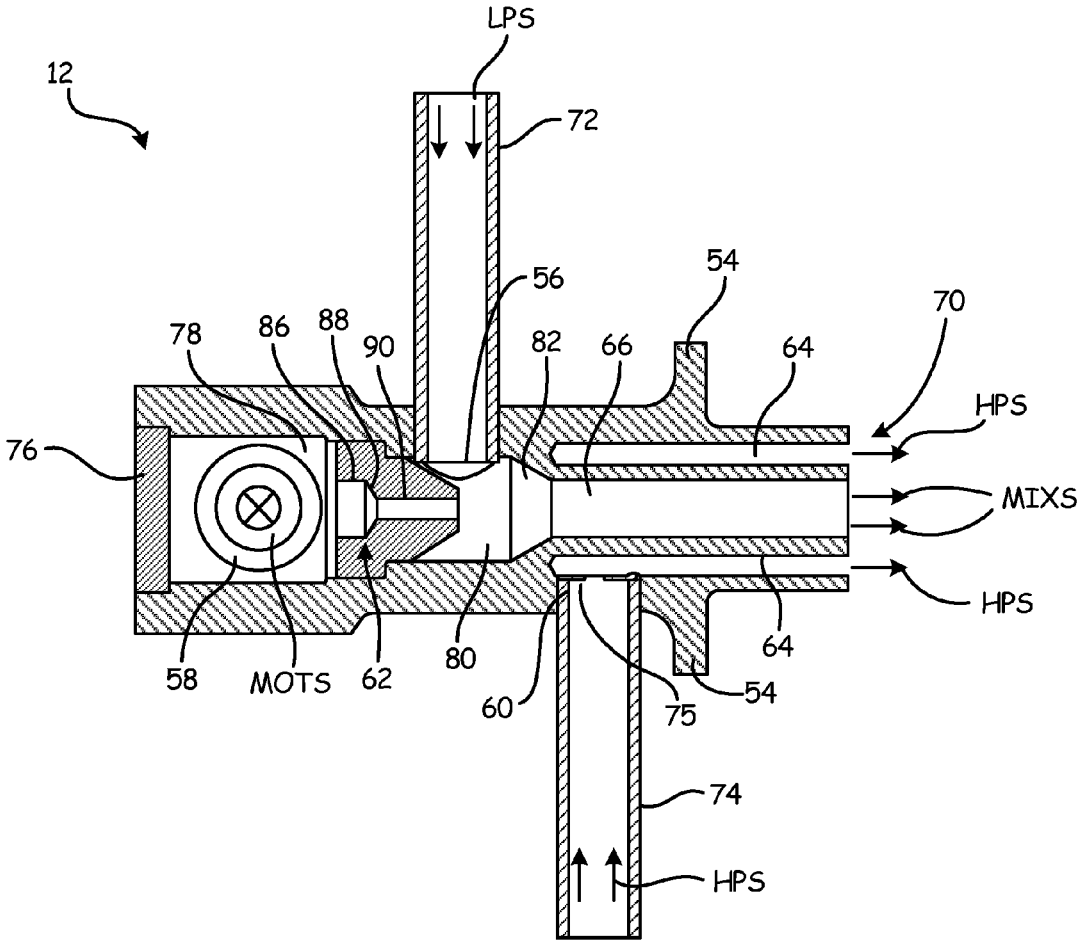
FIG. 2 is a cross-sectional of a three stream aspirator.

FIG. 2 is a sectional view of three stream aspirator 12, which includes mounting flange 54, low pressure inlet 56, motivator inlet 58, and high pressure inlet 60. Aspirator 12 also includes Venturi 62, isolated passage 64, mixing passage 66, aspirator discharge 70, low pressure tube 72, high pressure tube 74, and high pressure stream orifice 75. Aspirator 12 further includes aspirator cap 76, high pressure chamber 78, mixing chamber 80, and mixing passage nozzle 82. Venturi 62 further includes Venturi inlet passage 86, Venturi nozzle 88, and Venturi outlet passage 90. Also illustrated in FIG. 2 are low pressure stream LPS, motivating stream MOTS, high pressure stream HPS and mixed stream MIXS (which is produced by mixing Streams LPS and MOTS).

Venturi 62 resides within aspirator 12. The upstream side of Venturi 62 connects to motivator inlet 58 and the downstream side of Venturi 62 connects to low pressure inlet 56 and mixing chamber 66. Low pressure source 14 (of FIG. 1) connects to low pressure tube 72, which connects to low pressure source inlet 56. Low pressure source inlet 56 is located at the downstream end of low pressure tube 72, which is located inside of aspirator 12 near the outlet of Venturi 62. Water collector 18 (of FIG. 1) connects to motivator inlet 58, which resides near the proximate end of aspirator 12. Motivator inlet 58 then connects to the upstream side of Venturi 62 via high pressure chamber 78. Secondary heat exchanger outlet header port 22 (of FIG. 1) connects to high pressure tube 74, which connects to high pressure inlet 60. High pressure inlet 60 is located at the downstream end of high pressure tube 74, which is within aspirator 12, and connects to isolated chamber 64. Isolated chamber 64 also resides within aspirator 12. Discharge 70 is connected to mixing chamber 66 and isolated chamber 64, and is at the distal end of aspirator 12.

Low pressure inlet 56 enters mixing chamber 80 around the exit of Venturi 62. Mixing chamber 62 has a discharge, downstream and away from the proximate end of aspirator 12, that is connected to mixing passage nozzle 82. Mixing passage nozzle 82 is also connected, on its downstream end, to mixing passage 66. Mixing passage 66 continues through aspirator 12 to aspirator discharge 70 located at the distal end of aspirator 12.

High pressure tube 74, which connects to and penetrates aspirator 12, connects to isolated chamber 64 around high pressure inlet 60. At high pressure inlet 60, which is located at near the most downstream part of high pressure tube 60, is high pressure stream orifice 75. High pressure inlet 60 and high pressure stream orifice 75 are located near the most upstream portion of isolated chamber 64, which is the portion of upstream chamber 64 most near the proximate end of aspirator 12. Isolated chamber 64 continues through aspirator 12 and terminates within aspirator 12 at aspirator discharge 70, near the discharge of mixing passage 66, at the distal end of aspirator 12.

Aspirator cap 76 is located at the proximate end of aspirator 12 and abuts high pressure chamber 78. High pressure chamber 78 is connected to motivator inlet 58. Downstream of this connection and away from the proximate end of aspirator 12 is the outlet of high pressure chamber 78 which mates to the inlet of Venturi 62. Within Venturi 62, first Venturi passage 86 mates to the inlet of Venturi 62. Downstream of first Venturi passage 86 is Venturi nozzle 88, which connects to the discharge of first Venturi passage 86 and the inlet of second Venturi passage 90. Second Venturi passage 90 continues through Venturi 62 and terminates at the end of Venturi 62 into mixing chamber 80.

Also included on aspirator 12 is mounting flange 54. Mounting flange 54 extends from aspirator 12 near the distal end of aspirator 12, but may be located anywhere on aspirator 12 that allows for secure mounting of aspirator 12 to a mounting surface, which may be, for example, the header of a heat exchanger.

In one embodiment, motivating stream MOTS is a high pressure stream of fluid, which enters motivator inlet 58 and travels into high pressure chamber 78 and then into the inlet of Venturi 62. Motivating stream MOTS passes through first Venturi passage 86 and into Venturi nozzle 88, where the pressure of motivating stream MOTS decreases and the velocity increases. Motivating stream MOTS then continues to second Venturi passage 90 which directs motivating stream MOTS out of Venturi 62 and into mixing chamber 80, which has a diameter and cross-sectional area that is significantly larger than that of second Venturi passage 90. This process creates a Venturi effect, which causes a pressure vacuum to form in the chamber surrounding the discharge of Venturi 62. This abrupt change in cross-sectional area also lowers the velocity and increases the pressure of motivating stream MOTS as it enters mixing chamber 80.

Low pressure inlet 56 is located near the outlet of Venturi 62 and is therefore subject to the vacuum pressure. This vacuum then draws low pressure stream LPS into mixing chamber 80, as described in FIG. 1. Low pressure stream LPS and motivating stream MOTS begin combine in mixing chamber 80 to form mixed stream MIXS. Mixed stream MIXS continues out of mixing chamber 80 and into nozzle 82 which decreases the pressure and increases the velocity of mixed stream MIXS. Thereafter, mixed stream MIXS travels down mixing passage 66, where mixed stream MIXS continues to mix as it travels. Mixed stream MIXS is directed by mixing passage 66 to aspirator discharge 70 and out of aspirator 12 at the distal end of aspirator 12.

High pressure stream HPS enters into high pressure tube 74. High pressure stream HPS then continues through high pressure tube 74, to high pressure high pressure orifice 75 at high pressure inlet 60, prior to entering isolated chamber 64. High pressure stream orifice 75 lowers the pressure and increases the velocity of high pressure stream 70 as it enters isolated chamber 64. High pressure stream HPS then disperses within isolated chamber 64 and continues through aspirator 12 within isolated chamber 64. During its time in aspirator 12, high pressure stream HPS is isolated from motivating stream MOTS, low pressure stream LPS, and mixed stream MIXS. High pressure stream HPS then exits isolated chamber 64 at aspirator discharge 70.

The evaporating of liquid into ram air RA at ram air inlet 36, prior to ram air RA's entry into secondary heat exchanger 26, lowers the temperature of the ram air RA by absorbing heat from ram air RA as the liquid evaporates. This process is often referred to as adiabatic or evaporative cooling. In this process the evaporating liquid absorbs heat from the air and converts the sensible heat into latent heat. The process is called adiabatic, because there is no change in the enthalpy of the air or fluid into which the liquid is being evaporated. Evaporative adiabatic cooling may be performed on any fluid up to the point of that fluid's saturation point of the liquid being evaporated into the fluid. Maximum cooling of the fluid is achieved at the liquid saturation point of the fluid. This means there is a direct positive correlation between the quantity of liquid evaporated into the fluid, and the cooling of the fluid.

In times where saturation is not reached, the fluid is not being cooled to the maximum level. A third stream added to aspirator 12 may provide additional cooling to ram air RA any time motivator stream MOTS and low pressure stream LPS do not provide enough liquid to saturate ram air RA prior to its entry of secondary heat exchanger 26. Therefore, the third stream, high pressure stream HPS, will provide additional cooling to ram air RA (and therefore the process air) any time ram air RA would not become saturated by low pressure stream LPS and motivator stream MOTS.

Because more cooling can be performed with the same amount of air mass by incorporating a third stream, the process air will either leave secondary heat exchanger at a lower temperature than it would have without the incorporation of aspirator 12, or the heat exchanger may be made smaller to keep the same leaving temperature of the process air. In the first scenario, the air cycle machine will operate more efficiently due to lower temperatures, saving energy. In the second scenario, energy will be saved in the turbine engines, which do not have to work as hard due to the weight reduction of the heat exchangers.

The use of aspirator 12 to supply liquid to be injected into ram air RA is desirable not only to increase the efficiency of the heat exchangers, but to remove water from the system. Removal of water from the system is desirable, because water may have damaging effects on process components such as turbines or compressors within aircraft cooling system 10. The water is expelled from aircraft cooling system 10 at ram air exit 38, which is dumped overboard of the aircraft. Therefore it may be desired to inject additional liquid sources into the aspirator to be discharged into a heat exchanger.

Because of the delicate fluid mechanic balance required to incite the Venturi effect, other high pressure streams cannot be introduced into the aspirator pump without careful consideration requiring design, analysis, and testing under many conditions. This becomes even more complex when it is desired to incorporate two streams from separate high pressure sources into an aspirator. Combining the streams upstream of the aspirator may cause problems to arise such as one high pressure stream flowing into the other high pressure stream, which may seriously disrupt the process from which the other high pressure stream originated. Also, injecting one high pressure stream into the aspirator downstream of the Venturi and upstream of the inlet may upset the suction pressure and therefore the flow of the low pressure stream into the aspirator.

A solution to these problems is to add isolated chamber 64 into the body of the aspirator. This allows a second high pressure stream to enter the aspirator, but remain isolated from motivating stream MOTS and low pressure stream LPS until after all streams have discharged from the aspirator. This allows for the use of multiple pressure streams in a compact and lightweight device. By incorporating the stream into the aspirator as opposed to creating an additional aspirator or nozzle, the number of penetrations and devices are reduced, saving cost and time. Further, this modification allows for the remainder of the system to remain substantially unchanged (apart from high pressure stream path 24 and secondary heat exchanger outlet header port 22), which simplifies the system installation. Also, adding few new components to a system allows for existing systems operating with a standard aspirator to be upgraded to a three stream aspirator more easily.

Isolated passage 64 has been illustrated and described to include a passage which surrounds mixing passage 66; however, isolated passage 64 may be incorporated in many ways into an aspirator, such as a side-by-side parallel flow arrangement, or any other arrangement allowing for two or more independent streams to flow.

Aspirator 12 has been described as including isolated passage 64; however, aspirator 12 may include multiple isolated passages for ejecting multiple streams of fluid from multiple different sources.

The sources of aspirator 12 have been described as secondary heat exchanger outlet header port 22, water collector 18, and low pressure source 14. These sources may be water collectors or water separators as described herein, or may be any other useable source of fluid within an aircraft system.

Aspirator 12 has been primarily described as being components of aircraft cooling system 10. However, aspirator 12 may be applied to various applications requiring the combination or handling of multiple streams, where it is desired to keep one of three streams separated from a high pressure and low pressure stream. For example, aspirator 12 may use high pressure air to motivate a low pressure chemical through aspirator 12. In this example water may be a third stream, which, when mixed with the chemical causes a reaction that is desired to occur outside of the aspirator.

Discussion of Possible Embodiments

The following are non-exclusive descriptions of possible embodiments of the present invention.

A three stream aspirator includes an upstream passage for receiving and discharging a motivator stream, a low pressure passage for receiving and discharging a low pressure stream, and a Venturi for receiving and discharging the motivator stream and for drawing the low pressure stream through the low pressure passage. The aspirator body also includes a mixing passage for receiving and mixing the motivator stream and the low pressure stream, and a first aspirator outlet, located at the end of the mixing passage, configured to discharge the mixed stream from the aspirator. The aspirator body further includes an isolated passage for receiving a high pressure stream, wherein the high pressure stream is isolated from any other stream while within the aspirator; and a second aspirator outlet, adjacent to the first aspirator outlet, from which the high pressure stream is discharged.

The aspirator of the preceding paragraph can optionally include, additionally and/or alternatively, any one or more of the following features, configurations and/or additional components.

The mixing passage can be substantially cylindrical and wherein the isolated passage may surround the mixing passage.

The aspirator may further include a plurality of isolated passages for receiving a plurality of high pressure streams.

The aspirator may further include a low pressure stream inlet, an isolated passage inlet, and an upstream passage inlet all having axes which can be perpendicular or parallel to an axis of the mixing passage.

A system, including any of the foregoing embodiments of the aspirator, wherein the system may include a heat exchanger for receiving a cooling stream, the mixed stream, and the high pressure stream, wherein the aspirator discharges the mixed stream and the high pressure stream into the heat exchanger so that liquid from the mixed stream and the high pressure stream evaporates into the cooling stream and reduces a temperature of the cooling stream.

The system further includes an air cycle machine configured to send a process stream to be cooled by the heat exchanger.

The air cycle machine may be configured to receive the process stream from the heat exchanger.

The heat exchanger further includes a header comprising a header port to collect the high pressure stream, and a tube for transporting the high pressure stream from the header to the isolated passage.

A high pressure water collector is located downstream of the heat exchanger, wherein the motivator stream may be collected from the high pressure water collector.

A low pressure water separator is connected to the air cycle machine, wherein the low pressure stream may be collected from the low pressure water separator.

A method for discharging two individual streams using a three stream aspirator includes supplying a motivator stream into a Venturi located within the aspirator, creating a Venturi effect and drawing a low pressure stream into a mixing chamber within the aspirator using the Venturi effect. The method also includes mixing the low pressure stream and the motivator stream in the mixing chamber to create a mixed stream and discharging the mixed stream from the mixing passage at a first outlet of the aspirator. The method further includes supplying a high pressure stream into an isolated passage, isolating the high pressure stream from the mixed stream, the low pressure stream, and the motivator stream within the aspirator, and discharging the high pressure stream from the isolated passage at a second outlet of the aspirator adjacent to the first outlet of the aspirator.

The system of the preceding paragraph can optionally include, additionally and/or alternatively, any one or more of the following features, configurations and/or additional components, or steps.

The high pressure stream and the mixed stream are discharged into a heat exchanger.

The high pressure stream and the mixed stream are mixed with a cooling stream within the heat exchanger.

Liquid from the mixed stream and the high pressure stream is evaporated into the cooling stream.

Evaporation of the liquid into the cooling stream reduces the temperature of the cooling stream.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A system comprising:

a three stream aspirator comprising:

an upstream passage for receiving and discharging a motivator stream;

a low pressure passage for receiving and discharging a low pressure stream;

a Venturi for receiving and discharging the motivator stream and for drawing the low pressure stream through the low pressure passage;

a mixing passage for receiving and mixing the motivator stream and the low pressure stream;

a first aspirator outlet, located at the end of the mixing passage, configured to discharge the mixed stream from the aspirator;

an isolated passage for receiving a high pressure stream, wherein the high pressure stream is isolated from any other stream while within the aspirator; and a second aspirator outlet adjacent to the first aspirator outlet, from which the high pressure stream is discharged; and a heat exchanger for receiving a cooling stream, the mixed stream, and the high pressure stream, wherein the heat exchanger receives the mixed stream from the first aspirator outlet and receives the high pressure stream from the second aspirator outlet.

2. The system of claim 1, wherein the mixing passage is substantially cylindrical and wherein the isolated passage surrounds the mixing passage.

3. The system of claim 1, wherein the aspirator further comprises a plurality of isolated passages for receiving a plurality of high pressure streams.

4. The system of claim 1 and further comprising a low pressure stream inlet, an isolated passage inlet, and an upstream passage inlet all having axes which are perpendicular or parallel to an axis of the mixing passage.

5. The system of claim 1 and further comprising an air cycle machine configured to send a process stream to be cooled by the heat exchanger.

6. The system of claim 5, wherein the air cycle machine is configured to receive the process stream from the heat exchanger.

7. The system of claim 1, wherein the heat exchanger further comprises:

a header comprising a header port to collect the high pressure stream; and a tube for transporting the high pressure stream from the header to the isolated passage.

8. The system of claim 7 and further comprising a high pressure water collector located downstream of the heat exchanger.

9. The system of claim 5 and further comprising a low pressure water separator connected to the air cycle machine.

10. A method for discharging two individual streams using a three stream aspirator, the method comprising:

supplying a motivator stream into a Venturi located within the aspirator, creating a Venturi effect;

drawing a low pressure stream into a mixing chamber within the aspirator using the Venturi effect;

mixing the low pressure stream and the motivator stream in the mixing chamber to create a mixed stream;

discharging the mixed stream from the mixing passage at a first outlet of the aspirator;

supplying a high pressure stream into an isolated passage;

isolating the high pressure stream from the mixed stream, the low pressure stream, and the motivator stream within the aspirator;

discharging the high pressure stream from the isolated passage at a second outlet of the aspirator adjacent to the first outlet of the aspirator; and discharging the high pressure stream and the mixed stream into a heat exchanger.

11. The method of claim 10 and further comprising:

mixing the high pressure stream and the mixed stream with a cooling stream within the heat exchanger.

12. The method of claim 11 and further comprising:

evaporating liquid from the mixed stream and the high pressure stream into the cooling stream.

13. The method of claim 12 wherein evaporation of the liquid into the cooling stream reduces the temperature of the cooling stream.

* * * * *